United States Patent [19]

Meyer et al.

[11] 4,191,370

[45] Mar. 4, 1980

[54] PNEUMATIC EXERCISING DEVICE

[75] Inventors: Burton C. Meyer, Downers Grove; Ralph J. Kulesza; Alex Imatt, both of Chicago, all of Ill.

[73] Assignee: Marvin Glass & Associates, Chicago, Ill.

[21] Appl. No.: 855,027

[22] Filed: Nov. 25, 1977

[51] Int. Cl.[2] ..... A63B 21/00

[52] U.S. Cl. ..... 272/120; 46/178; 272/130; 272/DIG. 1

[58] Field of Search ..... 272/120, 121, 130, 144, 272/117, 116, DIG. 1; 46/87, 178, 179, 44; 35/11 R, 29 R; 254/93 R, 93 HP

[56] References Cited

U.S. PATENT DOCUMENTS

| | | | |
|---|---|---|---|
| 1,375,332 | 4/1921 | Stephens | 254/93 HP |
| 1,713,344 | 5/1929 | Lewis | 254/93 HP |
| 2,145,940 | 2/1939 | Marlowe | 272/130 X |
| 2,825,563 | 3/1958 | Lawton | 272/130 |
| 3,446,503 | 5/1969 | Lawton | 272/120 |
| 3,578,318 | 5/1971 | Young | 272/1 R |
| 3,836,141 | 9/1974 | Franklyn | 272/130 |
| 3,997,157 | 12/1976 | Meyer | 46/44 X |

*Primary Examiner*—William R. Browne

*Attorney, Agent, or Firm*—Mason, Kolehmainen, Rathburn & Wyss

[57] ABSTRACT

A toy seat comprises a base with a seat mounted for movement between different levels above the base and a fluid chamber in the form of a bellows supports the seat on the base to move up and down. A hand pump is provided for supplying pressurized fluid to expand the fluid chamber to raise the seat to a level wherein suddenly the pressurized fluid in the chamber may be released to the atmosphere and the seat then settles downwardly until the pressurized fluid is again supplied to the chamber by manual operation of the pump. The toy seat also includes a whistle which is associated with an exhaust or release valve so that a whistling sound is produced whenever pressurized fluid from the seat supporting chamber is released.

12 Claims, 6 Drawing Figures

10
12
14
14a
16
18
18a
22
22a
24
26
28
30
32
34
36
38
40
42
44
44a
46
48
50
52
54
56
58
60
62
64
66
68
70
72
74
76
78
80
82
84
86
88
88a
90
92
92a
94
96
98
100
102
104
106
108
110
112
112a
A
C
D

PNEUMATIC EXERCISING DEVICE

BACKGROUND OF THE INVENTION

1. Field of the Invention

The present invention provides a new and improved toy seat which is adapted to be used by young children to provide fun and excitement along with good exercise for the arms and the legs.

2. Description of the Prior Art

A wide variety of children's toy seats have been provided in the past and many of these seats have been mounted on rolling bases and other structures resembling animals and the like.

It is an object of the present invention to provide a new and improved toy seat which is fun and exciting for a child to play with and which provides means for exercising the arms and legs.

Yet another object of the present invention is to provide a new and improved toy seat of the character described which is adapted to be raised to increasing elevations in response to hand pumping action.

Still another object of the present invention is to provide a new and improved toy seat of the character described which is raised to a predetermined level by hand actuated pumping action and upon reaching this level, a release valve mechanism is suddenly actuated to release pressurized fluid and thereby permit the seat to return downwardly back to a lower level.

Still another object and advantage of the present invention is to provide a seat of the character described in the foregoing object wherein the exact point or time when the seat supporting pressurized fluid is released comes normally as a surprise to the person sitting on the seat as they are continuing to operate a hand pump for raising the seat further upwardly.

Still another object of the present invention is to provide a new and improved toy seat which produces an audible sound or whistle when the fluid in the seat raising fluid chamber is suddenly released.

Another object of the invention is to provide a new and improved toy seat for children which is light in weight, easy to move about, neat in appearance and relatively low in cost.

Still another object of the present invention is to provide a new and improved toy seat which provides exercise for arms and legs of the person sitting in the seat as the seat is being pumped upwardly.

Yet another object of the invention is to provide a new and improved toy seat which provides an interesting and active pastime for young children.

SUMMARY OF THE INVENTION

The foregoing and other objects and advantages of the present invention are accomplished in an illustrated embodiment comprising a new and improved toy seat having a base with a seat mounted for movement between different levels above the base. The seat is supported on an expandable fluid chamber which is supplied with pressurized fluid from a hand pump for raising the seat to a predetermined level. When the seat reaches this predetermined level, a release valve is suddenly activated and fluid from the supporting fluid chamber is released to the atmosphere so that the seat may then settle downwardly until the release valve is again closed. The toy seat is provided with a whistle operatively associated with the exhaust or release valve so that a whistle-like audible sound is produced when the pressurized fluid in the seat supporting fluid chamber is suddenly released. The toy seat thus provides an active and entertaining activity for a child and is useful in providing exercise for the arms and legs as the seat is elevated by hand pumping action.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
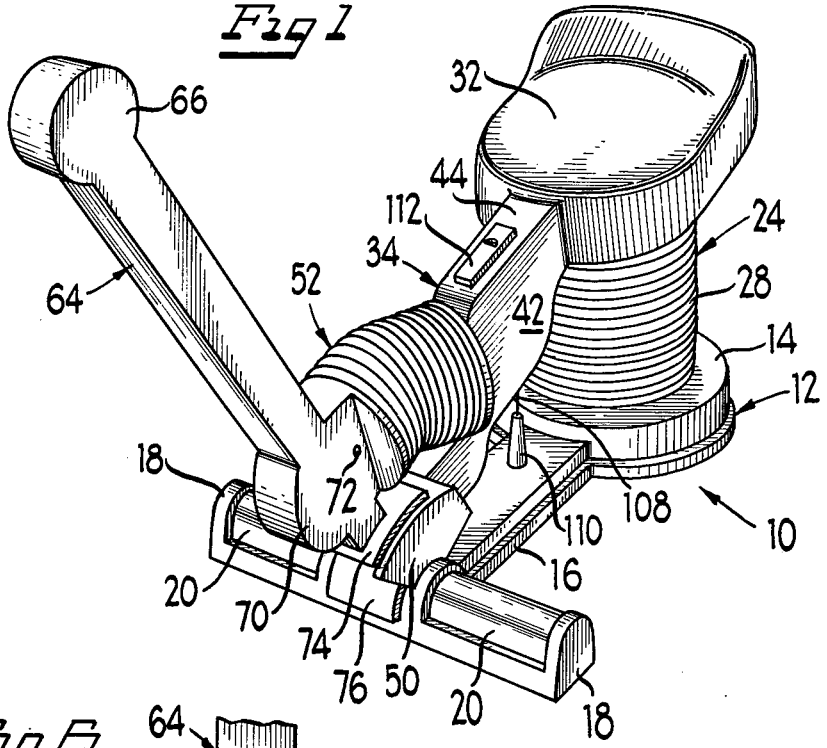
FIG. 1 is a front perspective view of a new and improved toy seat constructed in accordance with the features of the present invention.

Referring now more particularly to the drawings, in FIG. 1 is illustrated a new and improved toy seat constructed in accordance with the features of the present invention and referred to generally by the reference numeral 10. The toy seat is especially well adapted for use by young children and provides an entertaining pastime as well as exercise for the arms and legs. The seat includes a base 12 preferably formed of molded plastic material and shaped to provide a generally cylindrical rear end portion 14 and a relatively narrow intermediate portion 16 extending forwardly therefrom. At the forward end, the base is provided with a pair of laterally outwardly extending footrests 18 having lightly inset upper wall sections 20 adapted to help retain the feet or shoes in position.

Figures 2, 4:
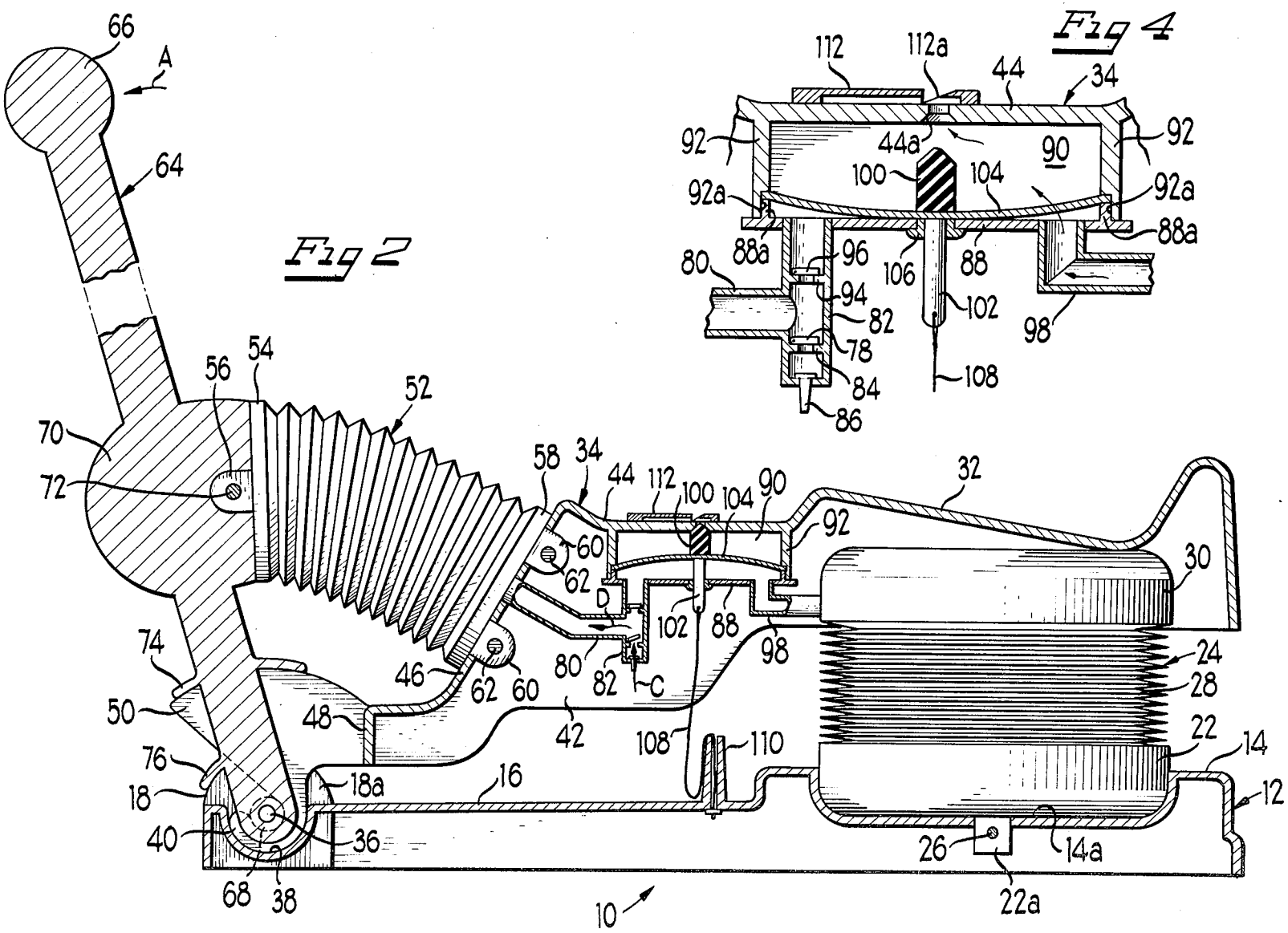
FIG. 2 is a longitudinal side elevation of the toy seat with portions cut away and shown in section for clarity.
FIG. 4 is an enlarged fragmentary sectional view of the exhaust valve mechanism of the toy seat.
Figure 3:
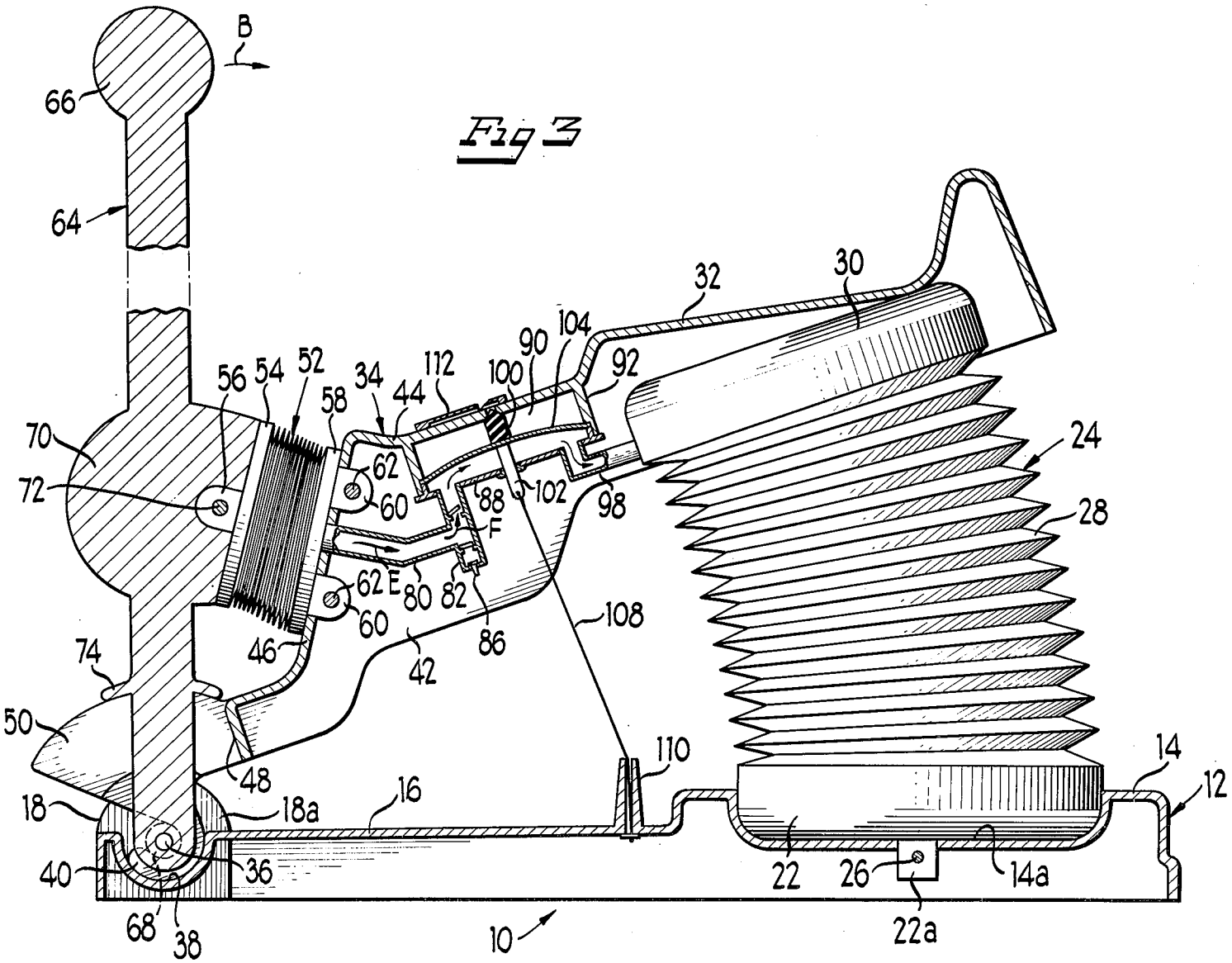
FIG. 3 is a longitudinal elevational view similar to FIG. 2 but illustrating the seat in a higher level position.

The rear end portion 14 includes a circular upper wall having a generally cylindrical recess **14*a* adapted to receive and hold the lower end wall 22 of a seat supporting bellows type expandable fluid chamber 24. The end wall 22 of the bellows is formed with a tang 22*a* at the center which depends downwardly and extends through an appropriately sized opening formed at the center of the recess 14*a* of the base so that the transverse lock pin 26 or other suitable fastener may be extended through the tang to secure the lower end of the fluid bellows in place as shown in FIGS. 2 and 3. The fluid chamber includes an intermediate, accordion-like, bellows section 28 which is expandable from a relatively short compressed condition as shown in FIG. 2 to an elongated or enlarged condition shown in FIG. 3, and at the upper end, the bellows is closed with an end wall 30 similar to the lower end wall 22**.

The expandable fluid chamber 24 provides support and lift for a molded plastic seat 32 which is raised and lowered in response to the pressure of the fluid within the fluid chamber.

Figure 6:
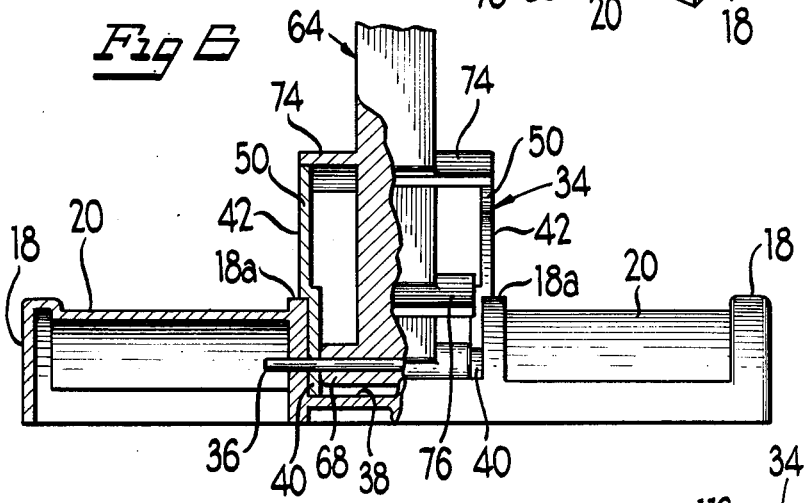
FIG. 6 is a fragmentary front elevational view with portions in section of the toy seat in accordance with the invention.

The seat 32 is mounted for relative pivotal movement on the base 12, and for this purpose an arm structure 34 of generally inverted channel shaped cross-section extends forwardly of the seat a- ' is secured for pivotal movement about an axle pin 36 mounted in coaxial alignment with the transverse footrests 18 as best shown in FIGS. 2, 3 and 6. As shown in FIG. 6, the axle 36 extends between a pair of inner end walls 18*a* formed on the footrest structures 18 and these inner end walls are connected by a trough-like wall structure 38 which forms a pocket around the axle 36 for receiving hook-like forward end projections 40 adjacent the forward end portions of opposite side walls 42 of the seat arm.

As indicated, the arm is of generally channel-shaped cross-section and the side walls 42 are integrally joined with a top wall 44, an intermediate forward wall 46 and a front end wall 48 which extends between the spaced hook-like projections 40 as best shown in FIGS. 2, 3 and 6. The hook-like projections 40 are formed adjacent the lower edges of a pair of spaced apart, arcuate sections 50 interconnected with the front end wall 48 and provided with curved upper edges concentric with respect to the pivot axle 36.

In accordance with the invention, the toy seat 10 includes a bellows type pumping chamber generally indicated by the reference numeral 52 which is expandable and contractible between the positions of FIGS. 2 and 3 as illustrated. The pump chamber includes a front end wall 54 having an outwardly projecting tang 56 at the center and a rear end wall 58 having a pair of tangs 60 which project through openings provided in the intermediate front wall 46 of the seat arm 34 as shown in FIGS. 2 and 3. Anchor pins 62 or other fasteners are provided to project through openings in the tangs and thereby secure the rear end wall 58 of the pump chamber against the intermediate forward wall 46 of the arm 34.

The pump chamber 52 is actuated to expand and contract in volume by means of a pump handle 64 having an enlarged knob 66 at the outer end to facilitate grasping. At the lower end, the pump handle is formed with a transversely extending hollow sleeve 68 mounted on the pivot axle 36 so that the handle may be rocked back and forth as indicated by the arrows "A" and "B" in FIGS. 2 and 3, toward and away from the seat 32 to expand and contract the volume of the pump chamber 52 as pumping action proceeds.

Intermediate the ends, the pump handle 64 is formed with an enlarged section 70 having a flat rearward face abutting the forward end wall 54 of the pump chamber. The tang 56 extends into a recess formed in the section 70 and a pin 72 or other fastener secures the tang in place as illustrated. Below the large segment 70 of the pump handle, there is provided an arcuately curved annular wall or curved cover segment 74 having an under surface which slides along and engages the curved upper edges of the arc segments 50 on the forward end portion of the seat arm 34. The cover segments 74 extend laterally outwardly from the edges of the pump handle and provide for lateral stability thereby minimizing strain on the axle 36.

Figure 5:
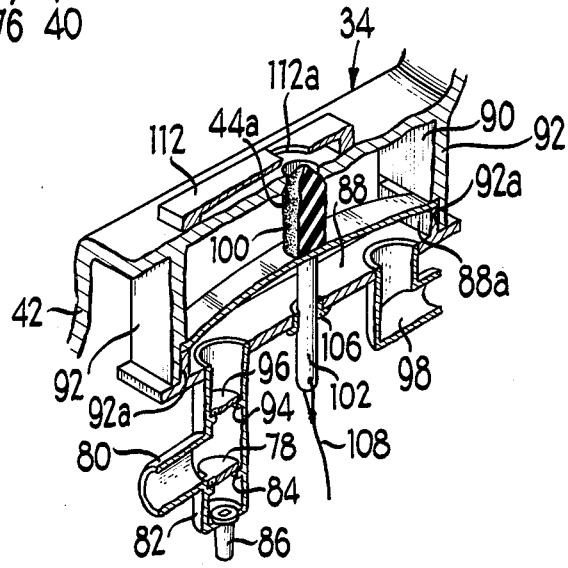
FIG. 5 is a fragmentary perspective view with portions in section showing the valving mechanism of the seat in accordance with the present invention.

In operating the toy, a person sits on the seat 32 with the feet on the inset portions 20 of the footrests 18 and the upper end 66 of the pump handle 64 is grasped and rocked back and forth as shown in FIGS. 2 and 3. Forward pivoting movement of the pump handle causes the pump chamber 52 to expand as shown and when this occurs, outside air flows into the interior of the pump chamber through an inlet check valve 78 and a conduit 80 connected to the end wall 58 of the pump chamber. The inlet check valve 78 permits an inflow of outside air in the direction of the arrow "C" through an opening in the lower end of a valve conduit 82 having an internal annular seat 84 for the check valve 78 which comprises a flat, waffer-like disk. As best shown in FIG. 5, the lower end of the valve conduit 82 is provided with an outlet opening in the lower end with a flanged squeaker plug 86 mounted therein to provide a squeaking sound upon an inflow of air. The valve 78 prevents an outflow of air to the atmosphere when the pressure in the conduit 82 is increased above atmospheric. When the pump handle is rocked forwardly, air flows into the conduit 82 past the squeaker plug 86 and inlet check valve 78 into the transverse conduit 80 leading to the pump chamber 52. This fluid flow path is indicated by the reference arrow "D" of FIG. 2.

At the upper end, the valve conduit 82 is connected to a lower wall 88 of a relief valve chamber 90 formed on the underside of the intermediate top wall 44 of the arm 34. The chamber 90 is closed at opposite, forward and rearward ends by a pair of integrally depending end walls 92 formed with inner shoulders or recesses 92*a* on the lower edges in order to receive upstanding flanges 88*a* formed on the bottom wall 88. The upper end of the valve conduit 82 communicates with the interior of the relief valve chamber 90 through an opening provided in the lower wall 88 as shown. Above the point of interconnection with the conduit 80 leading to the pump chamber 52, the valve conduit 82 is provided with an annular seat 94 and a disk type check valve 96 is mounted to cooperate with this seat to prevent the inflow of fluid from the relief valve chamber 90 into the pump chamber 52 when the pump chamber is expanded by forward movement of the pump handle 64.

After the pump handle is moved on a forward stroke to the full forward position for maximum expansion of the pump chamber 52, the pump handle is then rocked rearwardly as shown in FIG. 3, and this reduces the volume of the pump chamber and pressurizes the fluid therein forcing air through the passage 80 as shown by the arrows "E" and "F" upwardly past the valve seat 94 and check valve 96 into the relief valve chamber 90. During this time, the check valve 78 prevents the pressurized fluid from passing out into the open lower end portion of the valve conduit 82. Pressurized air from the relief valve chamber 90 flows into the main fluid chamber 24 through an interconnecting conduit 98 extending between an opening in the lower wall 88 and the upper end enclosure 30. This causes the fluid chamber 24 to expand and elevate the seat 32 to a higher level on each rearward rocking or pumping stroke of the pump handle 64. The amount of pulling force required to complete a pumping stroke depends upon the weight of the person sitting on the seat 32 and this action provides healthy exercise for the arms and legs of a person operating the toy seat. Each time the pump handle 64 is rocked forwardly as shown in FIG. 2, a fresh volume of outside air is drawn into the pump chamber 52 and the pressurized air already in the seat supporting fluid chamber 24 is prevented from escaping by the check valve 96 and seat 94. In each pumping cycle, the handle 64 is rocked back and forth, the seat 32 is raised in elevation and the squeaker plug 86 makes interesting and amusing squeaking noise as fresh air moves into the lower end of the valve conduit 82.

The pumping process is continued in this manner until the seat is raised to a predetermined elevation or level and the selected level is controlled by a relief valve 100 preferably formed of resilient material and having a conically tapered upper end which normally seats against a relief or vent opening 44*a* formed in the wall 44. The relief valve 100 is mounted on the upper end of an elongated valve stem 102 which projects downwardly through an opening in a central portion of a snap action, leaf spring 104 extending across the valve chamber 90 between the shouldered recesses 92*a* in the opposite end walls. In a normal or closed position as shown in FIGS. 2 and 5, the snap action leaf spring 104 is curved upwardly in the central portion and firmly biases the upper end of the relief valve 100 to close off the exhaust port 44*a*. The lower end of the valve stem 102 extends downwardly through the wall 88 of the relief valve chamber and is sealed with a grommet 106 which permits free sliding movement of the valve stem without leakage from the chamber. The lower end of the valve stem is connected to a cord 108 which is threaded downwardly through the central opening or bore in an upstanding sleeve 110 formed on the intermediate wall 16 of the base 12.

When the seat 32 is pumped upwardly by the handle 64 and eventually reaches a predetermined level, the valve cord 108 becomes taught and further pumping action causes the valve member 100 to unseat away from the exhaust port 44*a* which permits a rapid escape of fluid from fluid chambers 24 and 90. The length of the cord 108 can be adjusted from time to time to determine and change the level at which the relief valve is operated. In order to provide a more rapid release of the relief valve from the closed to the open position, a snap action spring 104 is utilized and when sufficient force is exerted by the cord 108 the spring 104 snaps from the closed position of FIGS. 2 and 5 to the open position of FIGS. 3 and 4. When this occurs, the pressurized fluid in the chamber 90 and interconnected fluid chamber 24 suddenly and rapidly escapes to the atmosphere through the orifice opening 44*a*. The precise level at which the valve opens is not readily apparent to a person sitting on the seat and pumping the handle 64 and it generally comes as a surprise when the relief valve opens and the seat begins to descend. This provides interesting action and a surprise to the person on the seat 32.

In accordance with the invention, the toy seat 10 includes a whistle enclosure 112 having a hollow resonating chamber above the opening 44*a*. This chamber has an outlet opening 112*a* and produces a whistling sound whenever the relief valve 100 is opened permittng an outflow of pressurized fluid from the chamber 90 and the seat chamber 24. The whistling sound also provides a sudden start and excitement when the seat pressure is suddenly released and the seat begins to descend.

Although the present invention has been described with reference to a single illustrated embodiment thereof it should be understood that numerous other modifications and embodiments can be devised by those skilled in the art that will fall within the spirit and scope of the principles of this invention.

What is claimed as new and desired to be secured by Letters Patent of the United States is:

1. A self-energizing exercising device utilizing the weight of the user as a resistive force, comprising:

a base structure;

a seat means for supporting the user mounted for movement between different generally vertical levels above said base structure;

a flexible bellows type fluid chamber supporting said seat means on said base structure expandable and contractable to raise and lower the level of said seat means;

bellows pump means for supplying pressurized fluid to expand said fluid chamber and actuable by a user while seated on said seat means;

means for releasing pressurized fluid from said fluid chamber to lower the seat means from a selected upper position; and handle means operable in generally a rowing fashion by a user positioned on the seat means for operating the pump means including a hand graspable portion mounted for movement toward and away from the seat means so as to require substantial movement of the user's arms and torso.

2. The exercising device of claim 1 wherein said releasing means includes a valve and means connected to said valve for opening the valve when said seat means reaches said selected upper position.

3. The exercising device of claim 2 wherein said valve is a snap action type including a seat means and a resilient needle, said needle being biased into engagement with said seat means by an overcentering means and movable to an open position in response to the means connected to said valve.

4. The exercising device of claim 1 including sounding means producing an audible sound using fluid released from said fluid chamber by said releasing means.

5. A self-energizing exercising device utilizing the weight of the user as a resistive force, comprising:

a base support structure;

a pivot axis defined on a forward end of the base and extending transversely to the base;

a seat means for supporting the user, said seat means being pivotally mounted on said pivot axis for movement between different generally vertical levels above the base support structure;

a bellows type fluid chamber means supporting said seat means on said base structure, said chamber means being flexible and contractable to raise and lower the level of the seat means;

bellows type pump means for supplying pressurized fluid to expand said fluid chamber;

check valve means between said pump means and said fluid chamber means; and handle means for selectively operating said pump means in generally a rowing type manner while the user is seated on the seat means, said handle means including a hand graspable, generally elongated arm pivotally mounted on said pivot axis for movement toward and away from said seat means so as to require substantial movement of the user's arms and torso during reciprocation of said handle means.

6. A self-energizing exercising device utilizing the weight of the user as a resistive force, comprising:

a base structure having a forward portion and a rearward portion;

a seat means for supporting the user positioned above said rearward portion of the base structure for movement between different generally vertical levels above said base structure;

a bellows type fluid chamber means supporting said seat means on said base structure and which is expandable and contractable to raise and lower the level of said seat means;

a bellows type pump means for supplying pressurized fluid to expand said fluid chamber means;

handle means for operating the pump means including a hand graspable portion mounted for movement toward and away from the seat means during a generally rowing type operation while the user is seated on the seat means, said handle means and said movable seat means being pivotally mounted on said forward base portion; and a pair of foot rests extending laterally outwardly from opposite sides of said handle bar means.

7. The toy seat of claim 6 wherein said pump means and said fluid chamber comprises a pair of variable volume bellows chambers in fluid communication with one another, and said handle means being interconnected to expand and contract the volume of one of said bellows chambers upon pivotal movement thereof.

8. The exercising device of claim 7 including check valve means in fluid communication between said chambers for permitting outside air to flow into one of said chambers upon expansion thereof by movement of said handle means in one direction.

9. The exercising device of claim 8 wherein said chambers include fluid and pump chambers, second check valve means in fluid communication between said chambers for preventing an inflow of air from said fluid chamber into said pump chamber during movement of said handle means in said one direction.

10. The exercising device of claim 9 wherein said second check valve means is operative to permit a flow of pressurized air from said pump chamber to expand said fluid chamber when said pump handle means is moved in an opposite direction.

11. The exercising device of claim 10 wherein said first mentioned check valve means is operative to prevent the loss of pressurized fluid to the outside when said pump handle is moved in said opposite direction.

12. The exercising device of claim 6 wherein said handle means and said movable seat means are pivotally mounted on the same axis.

* * * * *